US005285735A

United States Patent [19]

Motoi et al.

[11] Patent Number: 5,285,735

[45] Date of Patent: Feb. 15, 1994

[54] CONTROL APPARATUS FOR INJECTION QUANTITY OF PULVERIZED COAL TO BLAST FURNACE

[75] Inventors: Yasunori Motoi, Uozu; Matsuo Ohtaka, Ashiya; Makoto Numazawa, Nishinomiya, all of Japan

[73] Assignees: Diamond Engineering Co., Ltd., Tokyo; Sumitomo Metal Industries, Ltd., Osaka, both of Japan

[21] Appl. No.: 913,056

[22] Filed: Jul. 14, 1992

[30] Foreign Application Priority Data

Jul. 16, 1991 [JP] Japan ..... 3-175248

[51] Int. Cl.[5] ..... F23K 3/02

[52] U.S. Cl. ..... 110/101 CB; 110/101 CC; 110/101 CF; 110/106; 406/24; 222/368

[58] Field of Search ..... 110/101 R, 101 C, 101 CF, 110/101 CB, 101 CC, 106; 222/368, 52; 406/24, 12

[56] References Cited

U.S. PATENT DOCUMENTS

| | | | |
|---|---|---|---|
| 4,238,058 | 12/1980 | Heth . | |
| 4,389,949 | 6/1983 | Heep | 110/101 CB |
| 4,430,963 | 2/1984 | Finet | 110/101 CC |
| 4,605,036 | 8/1986 | Smith et al. . | |
| 4,758,118 | 7/1988 | Rachner et al. | 110/101 CF |

FOREIGN PATENT DOCUMENTS

| | | |
|---|---|---|
| 51-29684 | 8/1976 | Japan . |
| 58-23301 | 5/1983 | Japan . |
| 59-34605 | 8/1984 | Japan . |
| 59-213434 | 12/1984 | Japan . |
| 3-21454 | 3/1991 | Japan . |

OTHER PUBLICATIONS

"An Introduction To Blast Furnace Coal Injection" I. F. Carmichael & Davy McKee Corporation dated Mar. 1992.

*Primary Examiner*—Henry C. Yuen

*Attorney, Agent, or Firm*—Burns, Doane, Swecker & Mathis

[57] ABSTRACT

An apparatus for controlling the injection quantity of pulverized coal by measuring the flow rate of the pulverized coal in a conveying pipe, through which the pulverized coal is injected into tuyeres of a blast furnace, in order to regulate the opening of a valve installed between a feed tank and the conveying pipe based on the measured flow rate, and also by regulating the internal pressure of the feed tank so as to maintain the difference in the internal pressure between the feed tank and the conveying pipe within a predetermined range. The thus configured apparatus provides rapid-response and high-accuracy in control, wide-range controllability, and allows to control the injection quantity of the pulverized coal even when supplying the pulverized coal to the feed tank.

11 Claims, 7 Drawing Sheets

Fig. 6(a)
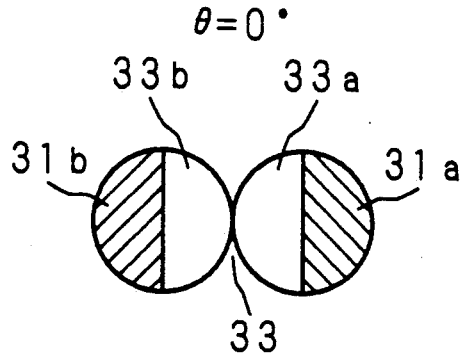
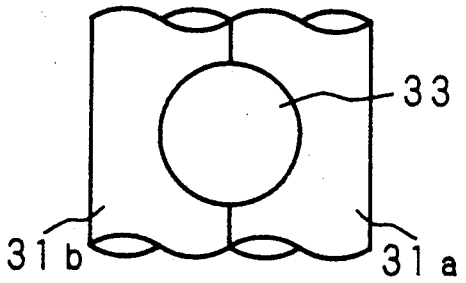
Fig. 6(a)'
Fig. 6(b)
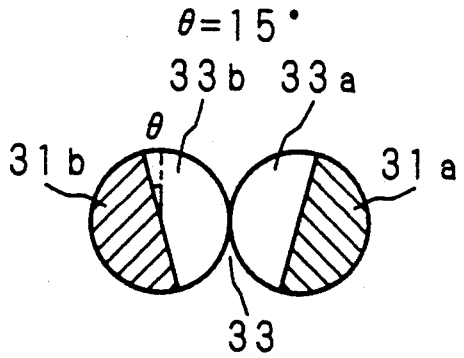
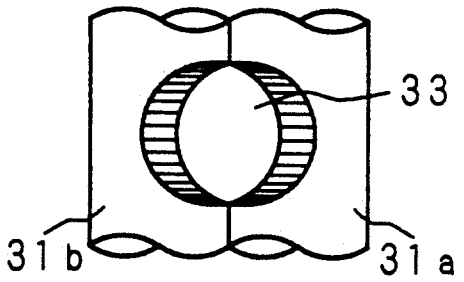
Fig. 6(b)'
Fig. 6(c)
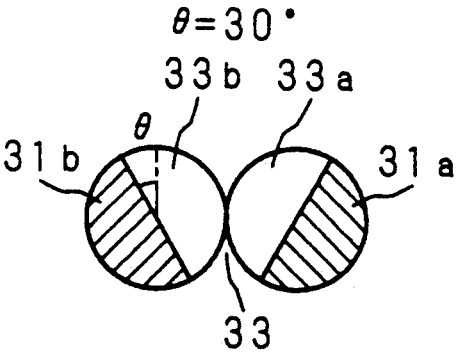
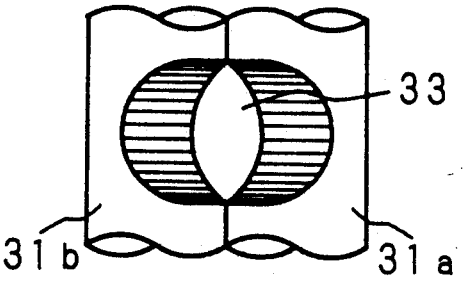
Fig. 6(c)'
Fig. 6(d)
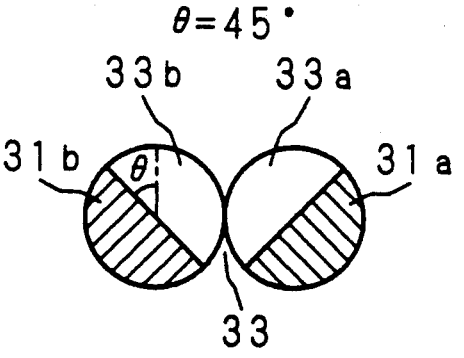
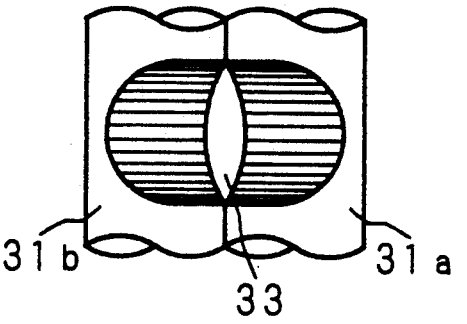
Fig. 6(d)'

Fig. 6(e)
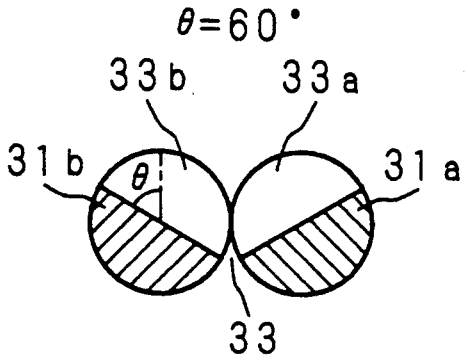
Fig. 6(f)
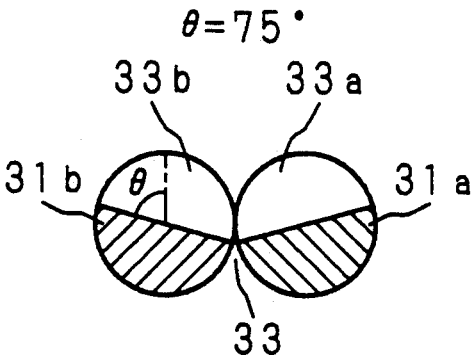
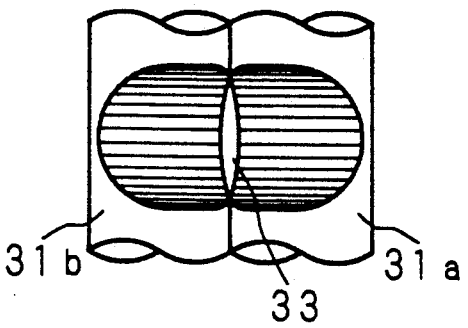
Fig. 6(e)'
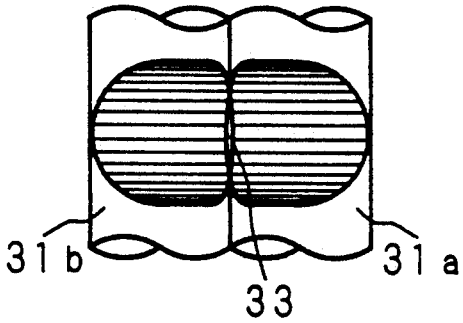
Fig. 6(f)'
Fig. 6(g)
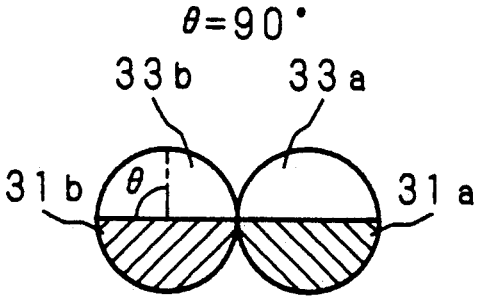
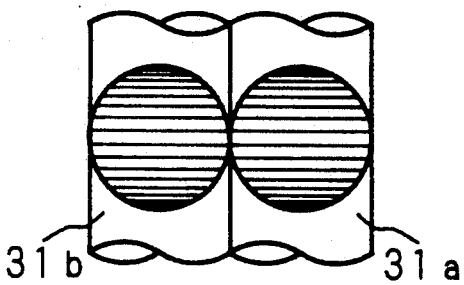
Fig. 6(g)'

CONTROL APPARATUS FOR INJECTION QUANTITY OF PULVERIZED COAL TO BLAST FURNACE

BACKGROUND OF THE INVENTION

1. Field of the Invention

The present invention relates to an apparatus for controlling the injection quantity of pulverized coal, which is installed in a system for injecting pulverized coal into a blast furnace.

2. Description of the Related Art

For a pulverized coal injection system to a blast furnace, there are known the following methods for controlling the quantity of pulverized coal injected from a pressurized vessel (that is, a feed tank) (refer to Japanese Patent Publication Nos. 51-29684, 58-23301, 59-34605, 3-21454, and Japanese Patent Application Laid-Open No. 59-213434).

(1) Method of controlling the injection quantity of pulverized coal by regulating the pressure in the feed tank In this method, a signal corresponding to the weight of pulverized coal measured by a load cell attached to a feed tank is differentiated with respect to time to calculate the injection rate of pulverized coal from the feed tank, and the internal pressure of the feed tank is regulated so that the injection rate becomes a prescribed rate, thereby to control the injection quantity of pulverized coal.

FIG. 1 is a schematic diagram illustrating the configuration of an apparatus implementing this method. In the figure, chain lines indicate signal flows. The reference numeral 1 designates an equalizing tank for temporarily storing pulverized coal and supplying it under pressure to a feed tank 2. The feed tank 2 is provided with a load cell 5 for measuring the weight of pulverized coal in the feed tank 2. Connected to the load cell 5 is a powder weight indicating controller 16. A signal of the injection rate of the pulverized coal from the powder weight indicating controller 16, a signal of the internal pressure of a powder conveying pipe 8, and a signal of the internal pressure of the feed tank 2 are fed to a differential pressure indicating controller 7, which regulates the internal pressure of the feed tank 2 by detecting the difference in internal pressure between the feed tank 2 and the powder conveying pipe 8.

The following describes the operation for controlling the injection quantity of pulverized coal according to this method.

When the weight of pulverized coal in the feed tank 2 is measured by the load cell 5, the signal of the measured weight is fed to the powder weight indicating controller 16 which then differentiates the signal of the measured weight with respect to time to calculate the injection rate of the pulverized coal and controls the differential pressure indicating controller 7 so that the injection rate is maintained at the prescribed rate. The differential pressure indicating controller 7 controls the internal pressure of the feed tank 2 by introducing a pressurizing gas into the feed tank 2 so that the difference in the internal pressure between the feed tank 2 and the powder conveying pipe 8 becomes the differential pressure corresponding to a predetermined injection rate of the pulverized coal.

(2) Method of controlling the injection quantity of pulverized coal by regulating the rotational speed of a rotary feeder (2.1) A signal corresponding to the weight of pulverized coal measured by a load cell attached to a feed tank is differentiated with respect to time to calculate the injection rate of pulverized coal from the feed tank, and the rotational speed of a rotary feeder is regulated so that the injection rate becomes a prescribed rate, thereby to control the injection quantity of pulverized coal.

FIG. 2 is a schematic diagram illustrating the configuration of an apparatus implementing this method. A feed tank 2 is provided with a load cell 5 for measuring the weight of the pulverized coal in the feed tank 2, and a rotary feeder 15 is installed in a lower outlet of the feed tank 2. A signal of the weight from the load cell 5 is fed to a powder weight indicating controller 16 which then supplies a control signal to the rotary feeder 15.

The following describes the operation for controlling the injection quantity of pulverized coal according to this method.

When the weight of pulverized coal in the feed tank 2 is measured by the load cell 5, the signal of the measured weight is fed to the powder weight indicating controller 16 which then differentiates the signal of the measured weight with respect to time to calculate the injection rate of the pulverized coal and controls the rotational speed of the rotary feeder 15 so that the injection rate is maintained at a prescribed value.

(2.2) From the flow rate of pulverized coal measured by a powder flow meter installed in a powder conveying pipe, the injection rate of pulverized coal from a feed tank is calculated, and the rotational speed of a rotary feeder is regulated so that the injection rate becomes a prescribed rate, thereby to control the injection quantity of pulverized coal.

FIG. 3 is a schematic diagram illustrating the configuration of an apparatus implementing this method. As shown, a rotary feeder 15 is installed in a lower outlet of a feed tank 2, while a powder flow meter 4 is installed in a powder conveying pipe 8. A measurement signal issued from the powder flow meter 4 is fed to a powder flow indicating controller 6 which then supplies a control signal to a rotary feeder 15.

The following describes the operation for controlling the injection quantity of pulverized coal according to this method.

When the flow rate of pulverized coal flowing through the powder conveying pipe 8 is measured by the powder flow meter 4, a signal of the measured flow rate is fed to the powder flow indicating controller 6 which then calculates the injection rate of the pulverized coal on the basis of the signal of the measured flow rate and controls the rotational speed of the rotary feeder 15 so that the injection rate is maintained at a prescribed value.

Problems in the above prior art methods of controlling the injection quantity will now be described.

Method (1) has the following problems.

(a) Since the injection rate of pulverized coal from the feed tank 2 is calculated by differentiating the signal measured by the load cell 5 attached to the feed tank 2, the obtaining of data on the injection rate is delayed by the calculation time which depends on the change in the weight of pulverized coal in the feed tank 2, resulting in slow control response.

(b) During pulverized coal being supplied into the feed tank 2 from the equalizing tank 1, the injection rate of the pulverized coal from the feed tank 2 cannot be calculated, since the detection of the change in the weight of the injected pulverized coal is impossible.

(c) Since the injection rate of the pulverized coal from the feed tank 2 is only controlled by regulating the pressure in the feed tank 2, fine adjustment of the control is not possible, and also, the response speed is slow.

Method (2.1) in (2) has the following problems.

(a) Since, the injection rate of pulverized coal from the feed tank 2 is calculated by differentiating the signal given from the load cell 5 like in the method (1), the control response is slow.

(b) During pulverized coal being supplied into the feed tank 2 from the equalizing tank 1, the injection rate of the pulverized coal from the feed tank 2 cannot be calculated like in the method (1).

(c) Although the rotary feeder is capable of fine adjustment of the injection rate of pulverized coal from the feed tank 2, the injection rate of pulverized coal per one rotary feeder is limited, and it is extremely difficult to increase the injection capacity of the rotary feeder; therefore, the only way to handle a large injection quantity is to increase the number of rotary feeders to be installed.

(d) Owing to the inherent construction of the rotary feeder, pulsation occurs in the injection of the pulverized coal from the feed tank 2, which disturbs continuity of the injection.

Method (2.2) in (2) has the following problems.

(a) Like in the method (2.1), although the rotary feeder is capable of fine adjustment of the injection rate of pulverized coal from the feed tank 2, the injection rate of pulverized coal per one rotary feeder is limited, therefore, the only way to handle a large injection quantity is to increase the number of rotary feeders to be installed.

(b) Like in the method (2.1), owing to the inherent construction of the rotary feeder, pulsation occurs in the injection of pulverized coal from the feed tank 2, which disturbs continuity of the injection.

(c) According to the above-mentioned problem (b), accuracy in the measurement by the powder flow meter 4 of pulverized coal passing through the powder conveying pipe 8 lowers. Therefore, accuracy in the calculation of the injection rate of pulverized coal lowers, thereby making the control itself of the injection rate of the pulverized coal unstable.

The above and further objects and features of the invention will more fully be apparent from the following detailed description with accompanying drawings.

SUMMARY OF THE INVENTION

The present invention aims at solving the above enumerated problems, and it is an object of the invention to provide an apparatus for controlling the injection quantity of pulverized coal, which realizes a fast response in controlling the quantity of pulverized coal injected from a feed tank to a blast furnace, which is capable of detecting the injection rate of pulverized coal even when the feed tank is receiving pulverized coal, and which is also capable of controlling the injection quantity with high accuracy.

BRIEF DESCRIPTION OF THE DRAWINGS

FIGS. 6(*a*)–(*g'*) are an explanatory diagram showing change in opening of the powder valve of FIG. 5.

DESCRIPTION OF THE PREFERRED EMBODIMENT

An apparatus for controlling the injection quantity of pulverized coal according to the present invention will now be described in detail below.

Figure 4:
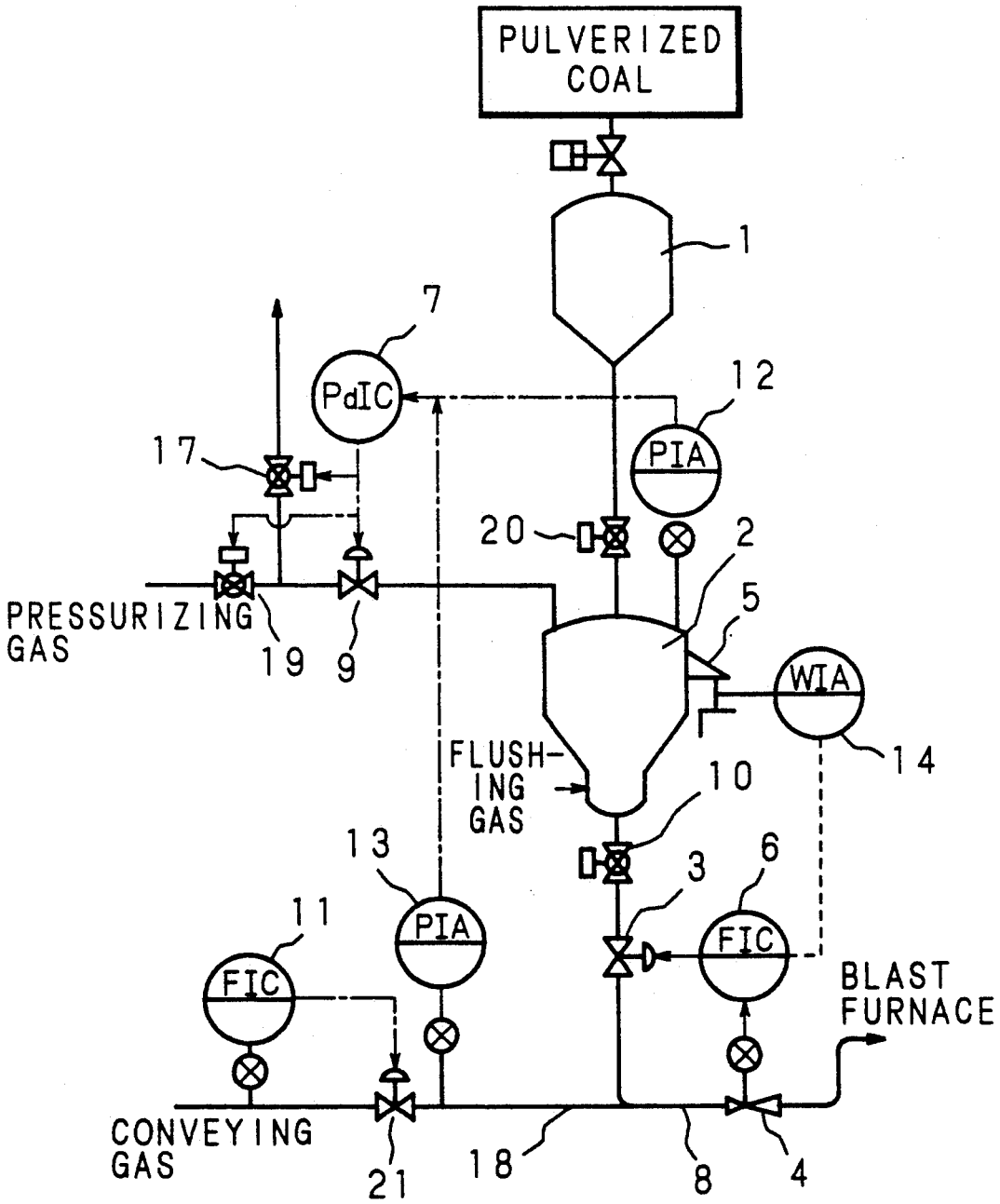
FIG. 4 is a schematic diagram illustrating the configuration of an apparatus for controlling the injection quantity of pulverized coal according to the present invention.

FIG. 4 is a schematic diagram illustrating the configuration of an apparatus for controlling the injection quantity of pulverized coal according to the present invention (hereinafter referred to as the apparatus of the invention). In FIG. 4, the reference numeral 1 designates an equalizing tank for temporarily storing pulverized coal and supplying it under pressure via a receiving valve 20 to a feed tank 2. A supply line for supplying a pressurizing gas to the feed tank 2 is connected to the feed tank 2, and an exhaust line for exhausting the pressurizing gas from the feed tank 2 is connected to the supply line. In the supply line are installed a pressurizing valve 19 and an internal pressure regulating valve 9, and in the exhaust line is installed an exhaust regulating valve 17. The feed tank 2 is also provided with a pressure indicator 12 for indicating the internal pressure of the feed tank 2 and a load cell 5 for measuring the weight of pulverized coal contained in the feed tank 2, the load cell 5 serving to back up the control of the injection quantity. A powder valve 3 is installed to the lower outlet of the feed tank 2, and a cutoff valve 10 is disposed between the lower outlet of the feed tank 2 and the powder valve 3. A powder weight indicator 14 is connected to the load cell 5. A signal issued from the powder weight indicator 14 is fed to a flow rate indicating controller 6 during the backup operation in the case where a signal from a powder flow meter 4 to be described later cannot be obtained owing to trouble in equipments.

The powder flow meter 4 is installed in a powder conveying pipe 8 near the feed tank 2, and the pulverized coal is injected through the conveying pipe 8 into the tuyeres of a blast furnace. A signal issued from the powder flow meter 4 is fed to the powder flow indicating controller 6 which then supplies a control signal to the powder valve 3 to make the difference between the flow rate through the powder conveying pipe 8 and a predetermined value zero.

Upstream of a point where the pulverized coal passed through the powder valve 3 is introduced into the powder conveying pipe 8 is a conveying gas main pipe 18 for supplying a conveying gas. The conveying gas main pipe 18 is provided with a conveying gas flow rate regulating valve 21, and a conveying gas flow indicating controller 11 in the upstream of the conveying gas regulating valve 21; the conveying gas flow indicating controller 11 supplies a signal to the conveying gas regulating valve 21 to regulate the opening of the valve.

Signals from the respective pressure indicators 12 and 13 for the feed tank 2 and the conveying gas main pipe 18 are fed to a differential pressure indicating controller 7. The differential pressure indicating controller 7 supplies control signals to the pressurizing valve 19, the internal pressure regulating valve 9 and the exhaust regulating valve 17 to maintain the difference in the internal pressure between the feed tank 2 and the conveying gas main pipe 18 at a predetermined value.

Both the pressurizing gas and the conveying gas are inert gases.

The operation of the above configured apparatus of the invention will now be described in detail.

After opening the receiving valve 20, pulverized coal is supplied from the equalizing tank 1 into the feed tank 2, then the receiving valve 20 is closed. After that, a compressed pressurizing gas from outside is introduced into the feed tank 2, while controlling the opening of the pressurizing valve 19 and the internal pressure regulating valve 9, to increase the pressure in the feed tank 2 up to a predetermined value. Next, the pulverized coal passes through the cutoff valve 10 installed in the lower outlet of the feed tank 2 and through the powder valve 3 installed immediately below the cutoff valve 10, resulting in being fed into the powder conveying pipe 8 through which a conveying gas and pulverized coal flow. In the stream of the conveying gas, the pulverized coal is conveyed to the tuyeres of the blast furnace. The flow rate of the conveying gas is independently controlled by the conveying gas flow indicating controller 11.

The powder flow meter 4 measures the flow rate of the pulverized coal flowing in the powder conveying pipe 8 and gives a signal of the measured value to the powder flow indicating controller 6. The powder flow indicating controller 6 controls the opening of the powder valve 3 so as to make the difference between the measured value and the predetermined flow rate of pulverized coal zero.

A signal from the load cell 5 through the powder weight indicator 14 is fed to the powder flow rate indicating controller 6 as an alternative 'signal of the flow rate of the pulverized coal' in the case where the signal of the flow rate from the powder flow meter 4 is not fed to the powder flow rate indicating controller 6.

Once the injection of pulverized coal from the feed tank 2 starts, pulverized coal is replenished under pressure from the equalizing tank 1 to the feed tank 2 via the receiving valve 20 when the pulverized coal in the feed tank 2 has lowered to a specified level. While replenishing pulverized coal, the pressurizing valve 19 closes and the internal pressure regulating valve 9 opens, thereby to control the pressure in the feed tank 2 to be a prescribed constant value by means of the exhaust regulating valve 17.

After replenishing pulverized coal from the equalizing tank to the feed tank 2, the receiving valve 20 closes and the pressurizing valve opens. Thereafter, the difference in the internal pressure between the feed tank 2 and the conveying gas main pipe 18 is controlled to be a prescribed constant value by means of regulating the respective openings of the pressurizing valve 19, internal pressure regulating valve 9 and the exhaust regulating valve 17 as will be described later.

The internal pressures of the feed tank 2 and the conveying gas main pipe 18 are detected by the pressure indicators 12 and 13 respectively provided for the feed tank 2 and the conveying gas main pipe 18. From the signals of the detected pressures, the differential pressure indicating controller 7 calculates the difference in the internal pressure between the feed tank 2 and the conveying gas main pipe 18 so as to make the difference in internal pressure keep within a predetermined range by regulating the opening of the pressurizing valve 19, the internal pressure regulating valve 9 and the exhaust regulating valve 17. The internal pressure of the feed tank 2 during the injection of pulverized coal is controlled so that the difference in internal pressure with respect to the conveying gas main pipe 18 is maintained at a constant value within the range of 0.3 to 2.0 $kg/cm^2$, preferably 0.5 to 1.5 $kg/cm^2$.

As described above, the apparatus of the invention controls the injection quantity of pulverized coal by combining a mechanism for maintaining the internal pressure difference between the feed tank 2 and the conveying gas main pipe 18 to be a constant value and injecting a constant quantity of pulverized coal by the differential pressure, with a mechanism for controlling the injection quantity of pulverized coal by regulating the opening of the powder valve 3 on the basis of the flow rate through the powder conveying pipe 8 directly detected. Therefore, it is possible to control the injection quantity with high accuracy.

Furthermore, instead of relying on the weight data of pulverized coal which requires relatively long time to obtain data of the injection rate, the apparatus of the invention uses a value measured by the powder flow meter 4 which can immediately provide data of the injection rate, and thereby to regulate the opening of the powder valve 3 to control the injection quantity of pulverized coal, so that the control response is rapid.

Also, since the injection rate is detected on the basis of the flow rate of pulverized coal in the powder conveying pipe 8, which is measured by the powder flow meter 4, the injection rate can be surely detected even when the feed tank 2 receives pulverized coal.

As the powder valve 3, such a valve is applied that can continuously vary the cross sectional area of a flowing passage by varying the opening of the powder valve 3, and it is desirable to provide a substantially linear characteristic in relationship between the opening and the flow rate. A valve, for example, disclosed in Japanese Utility Model Application Laid-Open No. 1-150266 (1989) has such linear characteristic in relationship between the opening and the flow rate.

Figure 5A:
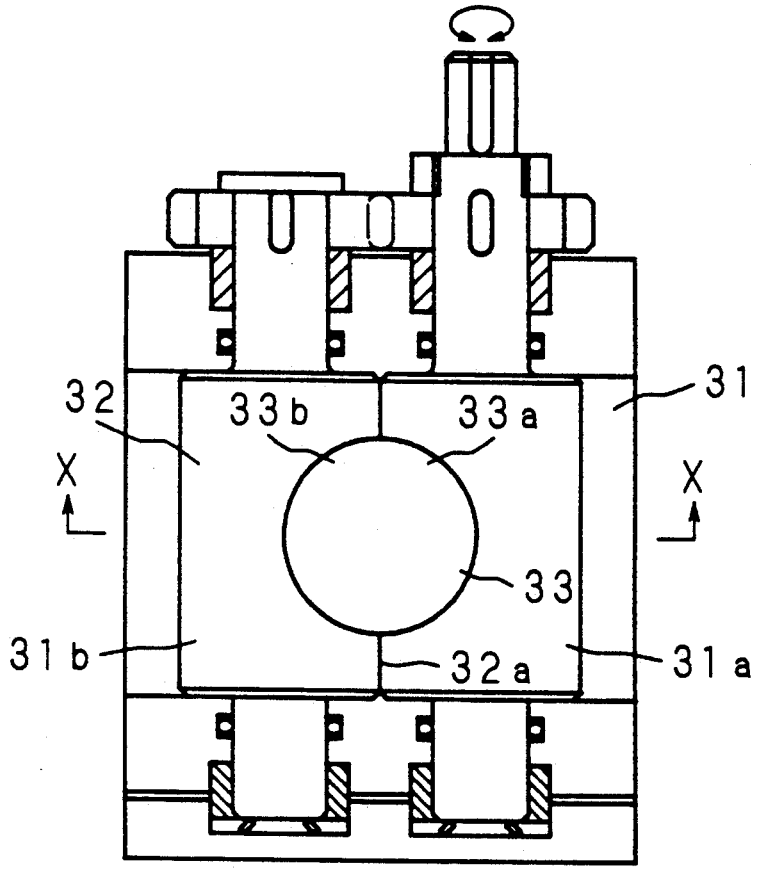
FIGS. 5(*a*)–5(*b*) are a plane view and cross sectional view of an example of a powder valve used for the apparatus of the invention.
Figure 5B:
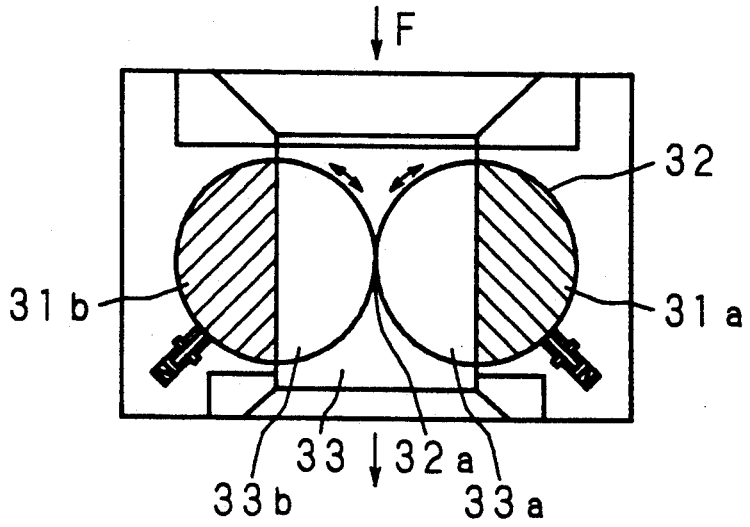

The above-described valve is shown in FIGS. 5(*a*) and 5(*b*). FIG. 5(*a*) is a plane view of the valve and FIG. 5(*b*) is a cross sectional view taken along the line X—X of FIG. 5(*a*).

In FIGS. 5(*a*) and 5(*b*), a valve element 31 comprises a pair of cylinders 31*a*, 31*b* being in tight contact with each other at respective peripheral surfaces 32, and is provided at right angles to a flowing direction F of a fluid. The cylinders 31*a* and 31*b* in the base point are provided with semi-circular notches 33*a*, 33*b* formed symmetrically from the peripheral surfaces 32 of the cylinders 31*a*, 31*b* being in tight contact with each other in the radial direction of the respective cylinders 31*a*, 31*b*. The cylinders 31*a*, 31*b* defines the opening 33 for the fluid in the valve element 31 altogether.

As one cylinder 31*a* of the valve element 31 is rotated, the other cylinder 31*b* is rotated followingly.

FIGS. 6(*a*) through 6(*g'*) show the change of the area of the opening 33 of the valve element 31 when the cylinder 31*a* is rotated thereby to change an inclining angle $\theta$ of the notched parts 33*a*, 33*b*. More specifically, FIGS. 6(*a*) and 6(*a'*) are diagrams of the opening 33 when the cylinders 31*a*, 31*b* are at the base position. FIGS. 6(*b*) through 6(*g*), in conjunction with respective side views 6(*b'*) through 6(*g'*), are diagrams when the inclining angle $\theta$ is 15°, 30°, 45°, 60°, 75° and 90°, respectively.

At the base position of FIG. 6(*a*), the flow passage of the fluid is fully opened. On the other hand, the flow passage is completely closed at the position of FIG. 6(*g*). At the positions indicated in FIGS. 6(*b*) through 6(*f*), the inclining angles $\theta$ are intermediate of the angle of the fully opened flow passage and that of fully closed. By rotating the cylinder 31*a* to change the inclining angle $\theta$ of the notched parts 33*a*, 33*b*, the area of the opening 33 can be adjusted.

In the above-described structure, the opening 33 provided in the valve element 31 comprising a pair of the cylinders 31*a*, 31*b* is at right angles to the flowing direction of the fluid, and the area of the opening 33 is controlled by the inclining angle $\theta$ of the notched parts 33*a*, 33*b* notched in the radial direction from the peripheral surfaces 32*a* where the cylinders 31*a*, 31*b* are in tight contact with each other. Therefore, the flowing direction of the fluid is never changed and disturbed due to the control of the area of the opening 33. Moreover, the inclining angle $\theta$ can be changed with ease by rotating the cylinder 31*b* following the rotation of the other cylinder 31*a* thereby to control the area of the opening 33. Accordingly, the flow rate of the fluid passing through the valve can be controlled.

The powder flow meter 4 may be either of differential pressure type or of electrical capacitance type.

The powder flow indicating controller 6 and the differential pressure indicating controller 7 may be either of analog or of digital type.

Figure 1:
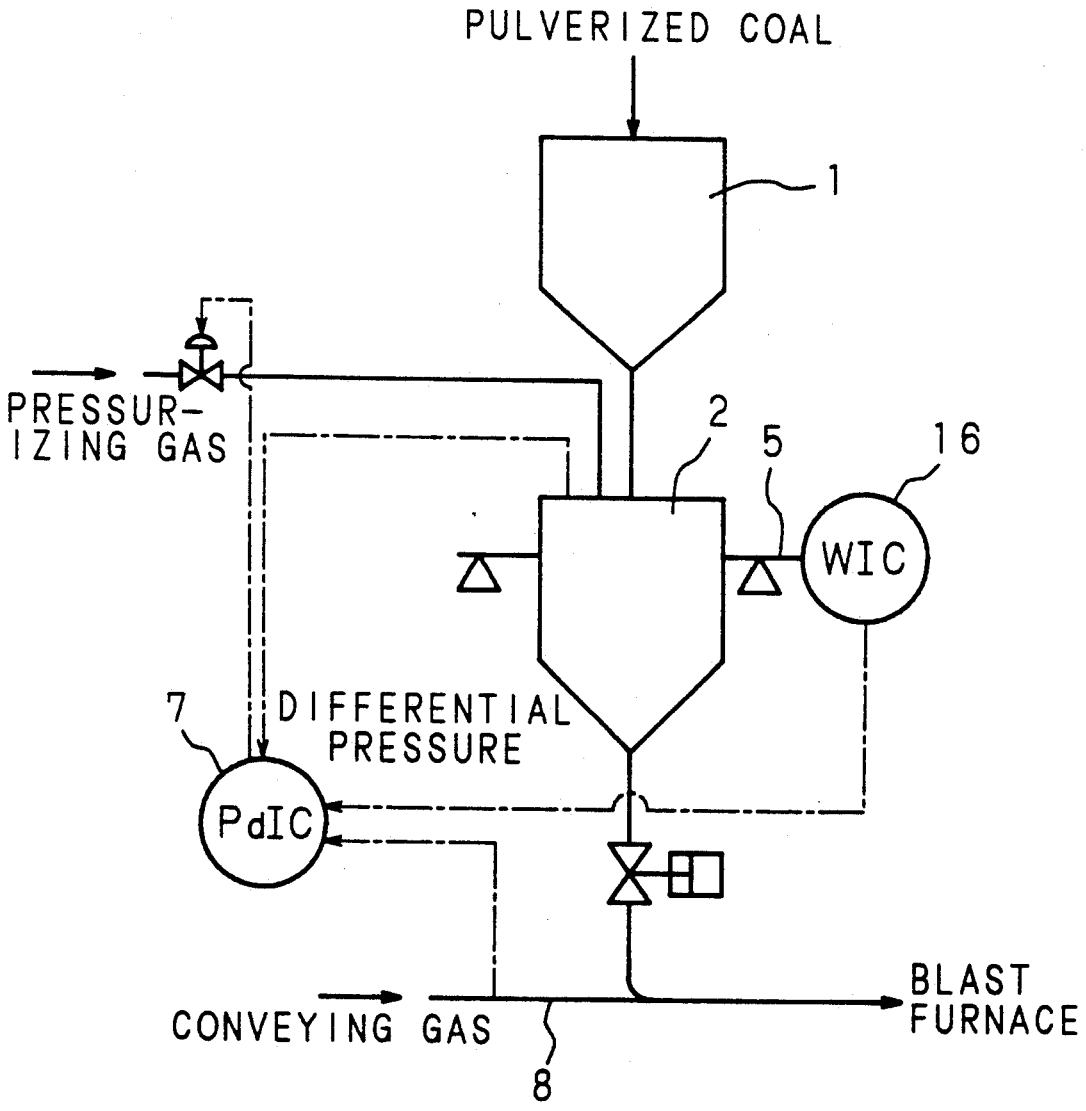
Fig. 1 Prior Art
FIG. 1 is a schematic diagram illustrating the configuration of a conventional apparatus for controlling the injection quantity of pulverized coal.
Figure 2:
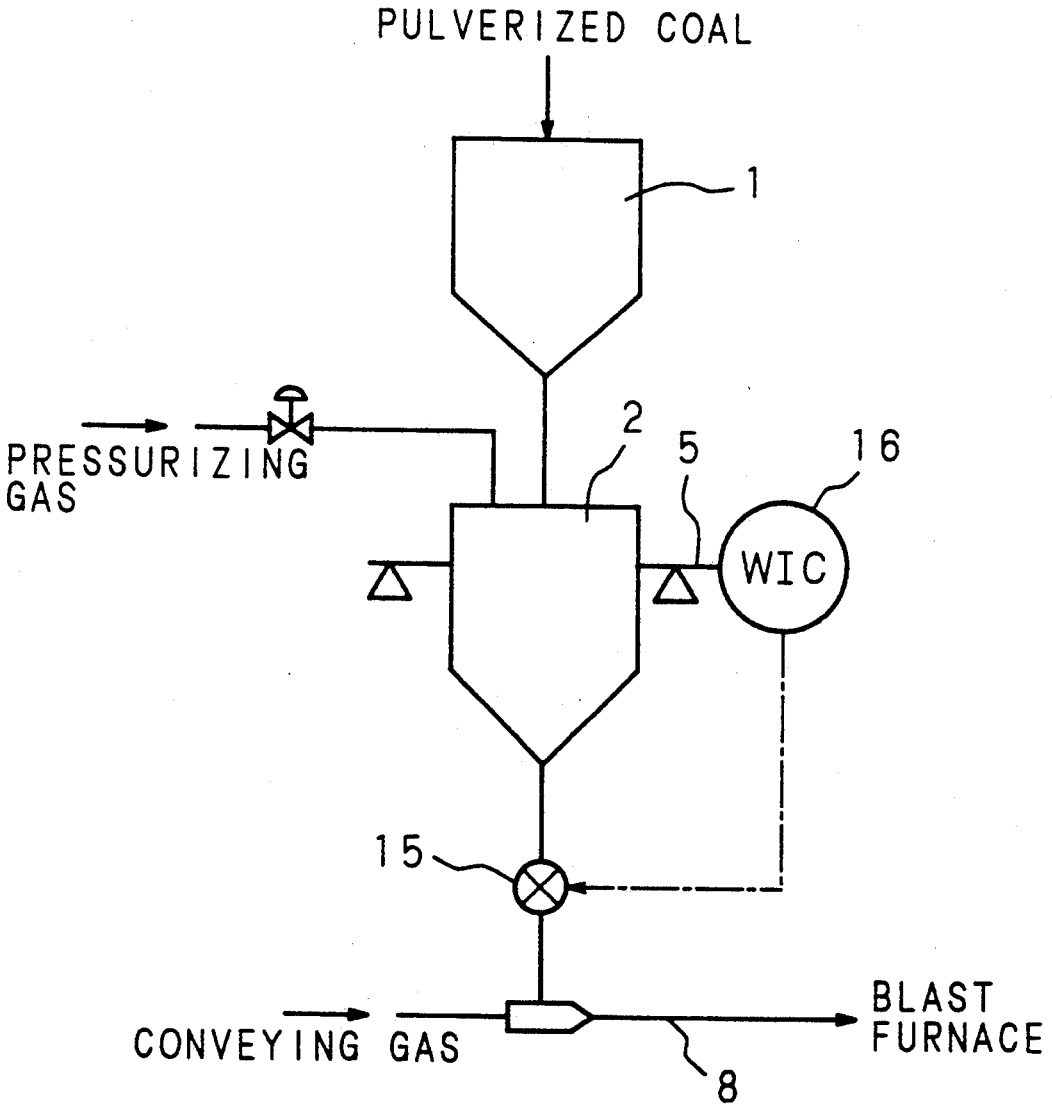
Fig. 2 Prior Art
FIG. 2 is a schematic diagram illustrating the configuration of another conventional apparatus for controlling the injection quantity of pulverized coal.
Figure 3:
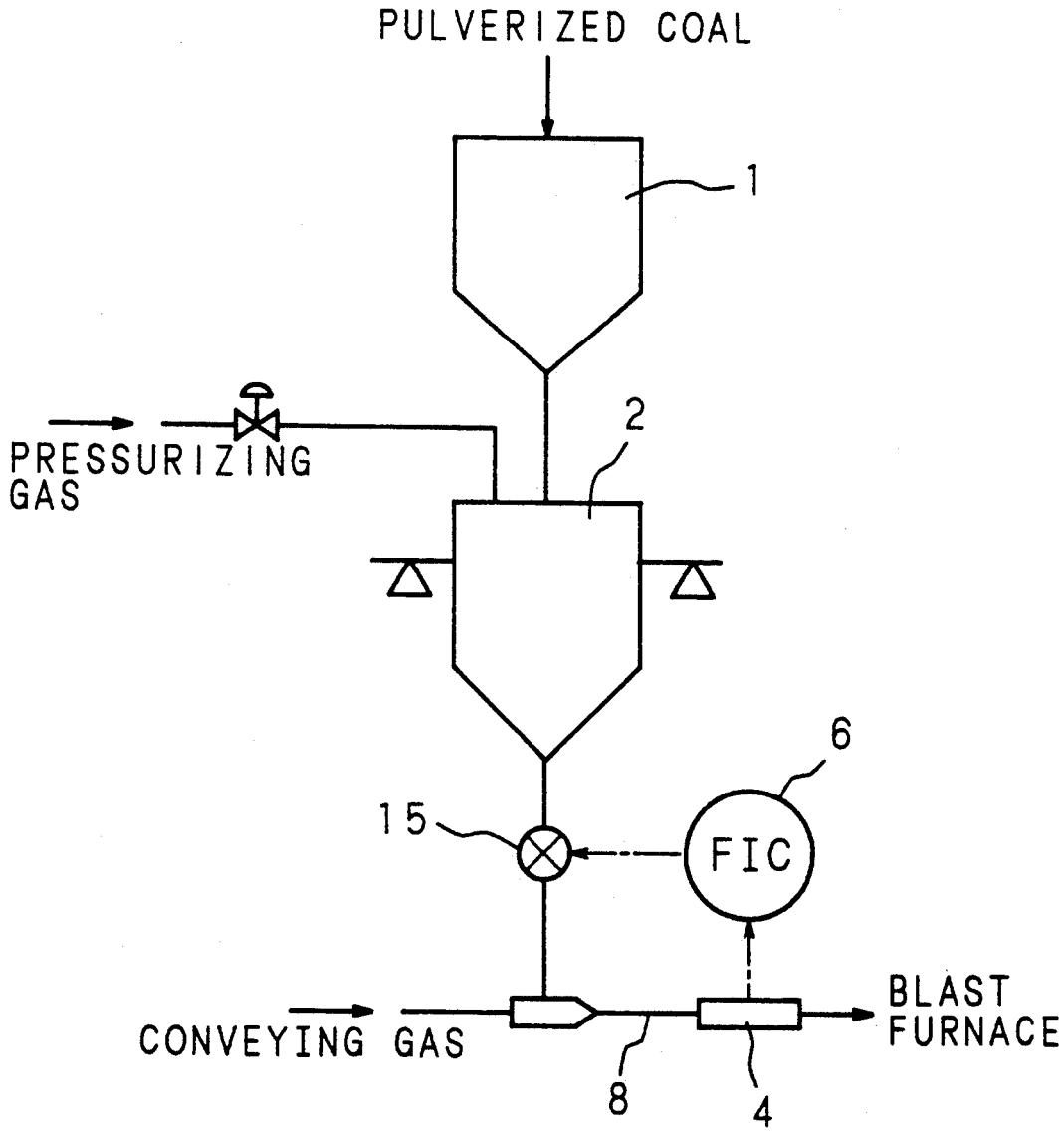
Fig. 3 Prior Art
FIG. 3 is a schematic diagram illustrating the configuration of a further conventional apparatus for controlling the injection quantity of pulverized coal.

Table 1 shows the comparison of control methods between the apparatus of the present invention and the conventional apparatus for controlling the injection quantity of pulverized coal. The apparatus of FIG. 1 is a designated as Prior Art 1, the apparatus of FIG. 2 as Prior Art 2 and the apparatus of FIG. 3 as Prior Art 3.

Table 2 shows the results of the injection quantity control performed using the apparatus of the present invention shown in FIG. 4, in comparison with the conventional examples. The pulverized coal used was prepared by mixing three brands, Bank, Optimum, and Woodland, the particle size of 200 mesh and lower accounting for more than 70 weight % of the mixture and the water content being 1.5 weight %.

Tests were conducted with the pulverized coal flow rates set at 12T/H and 24T/H respectively. The results showed that the flow rates actually measured were 12±0.15 T/H and 24±0.3 T/H, respectively; the deviations from the set flow rates were kept at minimum, demonstrating excellent injection accuracy (±1.25% in either case). The apparatus of the invention was also able to quickly adapt to the change of the flow rate from 12T/H to 24T/H.

As this invention may be embodied in several forms without departing from the spirit of essential characteristics thereof, the present embodiment is therefore illustrative and not restrictive, since of the scope of the invention is defined by the appended claims rather than by the description preceding them, and all changes that fall within the metes and bounds of the claims, or equivalence of such metes and bounds thereof are therefore intended to be embraced by the claims.

TABLE 1

| | Prior Art 1 | Prior Art 2 | Prior Art 3 | This invention |
|---|---|---|---|---|
| Control method | Differential pressure control | Rotational speed control of rotary feeder | Rotational speed control of rotary feeder | Differential pressure control + Opening control of powder valve |
| Injection quantity control means of pulverized coal | Differential pressure control between feed tank & powder conveying pipe only | Rotational speed control of rotary feeder only | Rotational speed control of rotary feeder only | Differential pressure control between feed tank and conveying gas main pipe & Opening control of powder valve |
| Injection rate detection means of pulverized coal | Load cell installed in feed tank | Load cell installed in feed tank | Powder flow meter installed in powder conveying pipe | Powder flow meter installed in powder conveying pipe (load cell in feed tank for backup) |

TABLE 2

| | Prior Art 1 | Prior Art 2 | Prior Art 3 | This invention |
|---|---|---|---|---|
| Injection accuracy | ±5% | ±3% | ±3% | within ±2% |
| Fine adjustment of injection quantity | Not possible | Possible | Possible | Possible |
| Control response speed | Slow | Slow | Rapid | Rapid |
| Continuity of injection | Possible | Not possible (due to pulsation) | Not possible (due to pulsation) | Possible |
| Minimum controllable injection rate | 1/6 of max. speed | ¼ of max. speed | ¼ of max. speed | 1/10 of max. speed |
| Large-volume injection | Possible (Max. 80 T/H per unit) | Not possible (Max. 20 T/H per unit) | Not possible (Max. 20 T/H per unit) | Possible (Max. 80 T/H per unit) |
| Injection quantity | Not possible | Not possible | Possible | Possible |

TABLE 2-continued

| | Prior Art 1 | Prior Art 2 | Prior Art 3 | This invention |
|---|---|---|---|---|
| detection during reception of pulverized coal | | | | |

What is claimed is:

1. In a pulverized coal injection system for injecting pulverized coal stored in a feed tank under pressure into a conveying pipe and for continuously injecting the pulverized coal into tuyeres of a blast furnace in a stream of a conveying gas blown to the pulverized coal, an apparatus for controlling the quantity of pulverized coal injected from the feed tank into the conveying pipe, comprising:

a valve for increasing or decreasing the flow rate of the pulverized coal injected from the feed tank into the conveying pipe according to the opening;

pressure gauges for detecting the internal pressures of the conveying pipe and the feed tank, respectively;

means for controlling the internal pressure of the feed tank so as to maintain the difference in the internal pressure between the conveying pipe and the feed tank at a prescribed value;

a flow meter for measuring the flow rate of the pulverized coal flowing in the conveying pipe; and means for controlling the opening of said valve so that the measured amount by said flow meter becomes a prescribed value.

2. An apparatus for controlling the injection quantity of pulverized coal as set forth in claim 1, wherein said means for controlling the internal pressure of the feed tank comprises a valve for supplying pressurizing gas to the feed tank, a valve for regulating the internal pressure of the feed tank, and a valve for exhausting the gas in the feed tank.

3. An apparatus for controlling the injection quantity of pulverized coal as set forth in claim 1, wherein the prescribed difference in the internal pressure between the conveying pipe and the feed tank is within the range of 0.3 to 2.0 kg/cm$^2$.

4. An apparatus for controlling the injection quantity of pulverized coal as set forth in claim 1, wherein the opening of the valve continuously varies to increase or decrease the flow rate of the pulverized coal continuously.

5. An apparatus for controlling the injection quantity of pulverized coal as set forth in claim 4, wherein said valve provides a substantially linear relationship between the opening and the flow rate.

6. An apparatus for controlling the injection quantity of pulverized coal as set forth in claim 1, wherein said flow meter is of differential pressure type.

7. An apparatus for controlling the injection quantity of pulverized coal as set forth in claim 1, wherein said flow meter is of electrical capacitance type.

8. An apparatus for controlling the injection quantity of pulverized coal as set forth in claim 1, wherein said means for controlling the internal pressure of the feed tank to maintain the internal pressure difference between the conveying pipe and the feed tank at a prescribed value comprises an analog differential pressure indicating controller.

9. An apparatus for controlling the injection quantity of pulverized coal as set forth in claim 1, wherein said means for controlling the internal pressure of the feed tank to maintain the internal pressure difference between the conveying pipe and the feed tank at a prescribed value comprises a digital differential pressure indicating controller.

10. An apparatus for controlling the injection quantity of pulverized coal as set forth in claim 1, wherein said means for controlling the opening of the valve so that the measured amount by the flow meter becomes a prescribed value comprises an analog flow indicating controller.

11. An apparatus for controlling the injection quantity of pulverized coal as set forth in claim 1, wherein said means for controlling the opening of the valve so that the measured amount by the flow meter becomes a prescribed value comprises a digital flow indicating controller.

* * * * *